US009340345B2

(12) United States Patent
Leser et al.

(10) Patent No.: US 9,340,345 B2
(45) Date of Patent: May 17, 2016

(54) STACK SHOULDER FOR INSULATED CONTAINER

(71) Applicant: BERRY PLASTICS CORPORATION, Evansville, IN (US)

(72) Inventors: Chris K Leser, Evansville, IN (US); John B Euler, Evansville, IN (US); Holger Aubele, Boehmenkirch (DE)

(73) Assignee: Berry Plastics Corporation, Evansville, IN (US)

( * ) Notice: Subject to any disclaimer, the term of this patent is extended or adjusted under 35 U.S.C. 154(b) by 0 days.

(21) Appl. No.: 14/213,355

(22) Filed: Mar. 14, 2014

(65) Prior Publication Data

US 2014/0263602 A1 Sep. 18, 2014

Related U.S. Application Data

(60) Provisional application No. 61/785,271, filed on Mar. 14, 2013.

(51) Int. Cl.
*B65D 21/02* (2006.01)
*B65D 81/38* (2006.01)

(52) U.S. Cl.
CPC ..... *B65D 81/3869* (2013.01); *B65D 21/0233* (2013.01); *B65D 81/3865* (2013.01); *B65D 81/3867* (2013.01)

(58) Field of Classification Search
USPC ..... 206/520
See application file for complete search history.

(56) References Cited

U.S. PATENT DOCUMENTS

| | | | | |
|---|---|---|---|---|
| 1,172,483 | A | 2/1916 | Rike et al. | |
| 2,816,697 | A | 12/1957 | Amberg | |
| 3,178,051 | A | 4/1965 | Bryant | |
| 3,237,803 | A | 3/1966 | Bryant | |
| 3,325,048 | A * | 6/1967 | Edwards | 206/520 |
| 3,375,954 | A | 4/1968 | Arvid et al. | |
| 3,420,397 | A | 1/1969 | Miller | |
| 3,425,382 | A | 2/1969 | Johnson | |
| 3,468,467 | A * | 9/1969 | Amberg | 229/403 |
| 3,471,075 | A | 10/1969 | Wolf | |
| 3,485,412 | A | 12/1969 | Hawley | |
| 3,580,468 | A | 5/1971 | McDevitt | |
| 3,648,888 | A | 3/1972 | Cheladze | |
| 3,995,740 | A * | 12/1976 | Amberg et al. | 206/520 |
| 4,049,122 | A | 9/1977 | Maxwell | |
| 4,102,454 | A | 7/1978 | Karevaara | |
| 4,106,397 | A * | 8/1978 | Amberg et al. | 493/105 |
| 4,117,971 | A * | 10/1978 | Itoh | 229/400 |
| 4,349,400 | A * | 9/1982 | Gilden | 156/217 |
| 5,062,568 | A | 11/1991 | Hill et al. | |
| 5,820,016 | A * | 10/1998 | Stropkay | 229/403 |
| 6,364,201 | B1 * | 4/2002 | Varano | 229/198.2 |
| 6,413,625 | B2 * | 7/2002 | Rolle et al. | 428/316.6 |
| 6,588,654 | B2 | 7/2003 | Nakashima | |

(Continued)

OTHER PUBLICATIONS

International Search Report and Written Opinion for International Application No. PCT1US20141028882, Aug. 5, 2014, 10 pages.

*Primary Examiner* — Gary Elkins
(74) *Attorney, Agent, or Firm* — Barnes & Thornburg LLP

(57) ABSTRACT

An insulative cup includes a side wall having an upper end formed to include a brim defining a mouth opening into an interior region formed at least in part by the side wall and a floor coupled to side wall. A stack shoulder configured to provide a support surface is formed in the side wall.

11 Claims, 3 Drawing Sheets

(56) References Cited

U.S. PATENT DOCUMENTS

| | | | | |
|---|---|---|---|---|
| 7,100,770 | B2 | 9/2006 | D'Amato | |
| 7,281,649 | B2 * | 10/2007 | Pyper, Jr. | 229/400 |
| 7,481,356 | B2 | 1/2009 | Stahlecker | |
| 7,677,435 | B2 | 3/2010 | Stahlecker | |
| 7,905,821 | B2 | 3/2011 | Stahlecker | |
| 7,972,669 | B2 * | 7/2011 | Matsuoka et al. | 428/36.5 |
| 7,984,846 | B2 | 7/2011 | Messerschmid et al. | |
| 8,146,796 | B2 | 4/2012 | D'Amato | |
| 8,172,127 | B2 | 5/2012 | Frost et al. | |
| 8,323,164 | B2 * | 12/2012 | Messerschmid | 493/154 |
| 2006/0118608 | A1 * | 6/2006 | Stahlecker | 229/403 |
| 2009/0159653 | A1 * | 6/2009 | Stahlecker | 229/403 |
| 2009/0184020 | A1 * | 7/2009 | Messerschmid et al. | 206/503 |
| 2010/0184877 | A1 * | 7/2010 | Miyagawa et al. | 521/56 |
| 2011/0174656 | A1 | 7/2011 | D'Amato | |
| 2011/0281704 | A1 | 11/2011 | Messerschmid et al. | |
| 2012/0241511 | A1 | 9/2012 | Marshall | |
| 2012/0318805 | A1 | 12/2012 | Leser et al. | |
| 2013/0001287 | A1 | 1/2013 | Stahlecker | |

* cited by examiner

STACK SHOULDER FOR INSULATED CONTAINER

PRIORITY CLAIM

This application claims priority under 35 U.S.C. §119(e) to U.S. Provisional Pat. App. No. 61/785,271, filed Mar. 14, 2013, which is expressly incorporated by reference herein.

BACKGROUND

The present disclosure relates to an insulated container, such as a cup, for containing hot or cold beverages or food. More particularly, the present disclosure relates to an insulated cup formed from polymeric materials and having a stack shoulder for engaging and receiving another insulated cup in a nested relationship.

SUMMARY

An insulated cup in accordance with the present disclosure includes a stack shoulder to facilitate stacking with a second cup. The stack shoulder is adapted to engage a bottom end of the second cup to limit how far the second cup can be inserted into an interior region of the insulative cup.

In illustrative embodiments, an insulative cup includes a body having a sleeve-shaped side wall including the stack shoulder, a rolled brim coupled to a top end of the sleeve-shaped side wall, and a floor mount coupled to a bottom end of the sleeve-shaped side wall. The sleeve-shaped side wall forms an interior region and the stack shoulder extends inwardly into the interior region.

In illustrative embodiments, the stack shoulder includes an annular seat-support ring having an upper end located adjacent to an upper side-wall portion of the sleeve-shaped side wall. The upper end of the stack support extends into the interior region and forms an annular ledge having an annular seat. The annular seat is adapted to receive and engage the bottom end of the second cup.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which.

Figure 3:
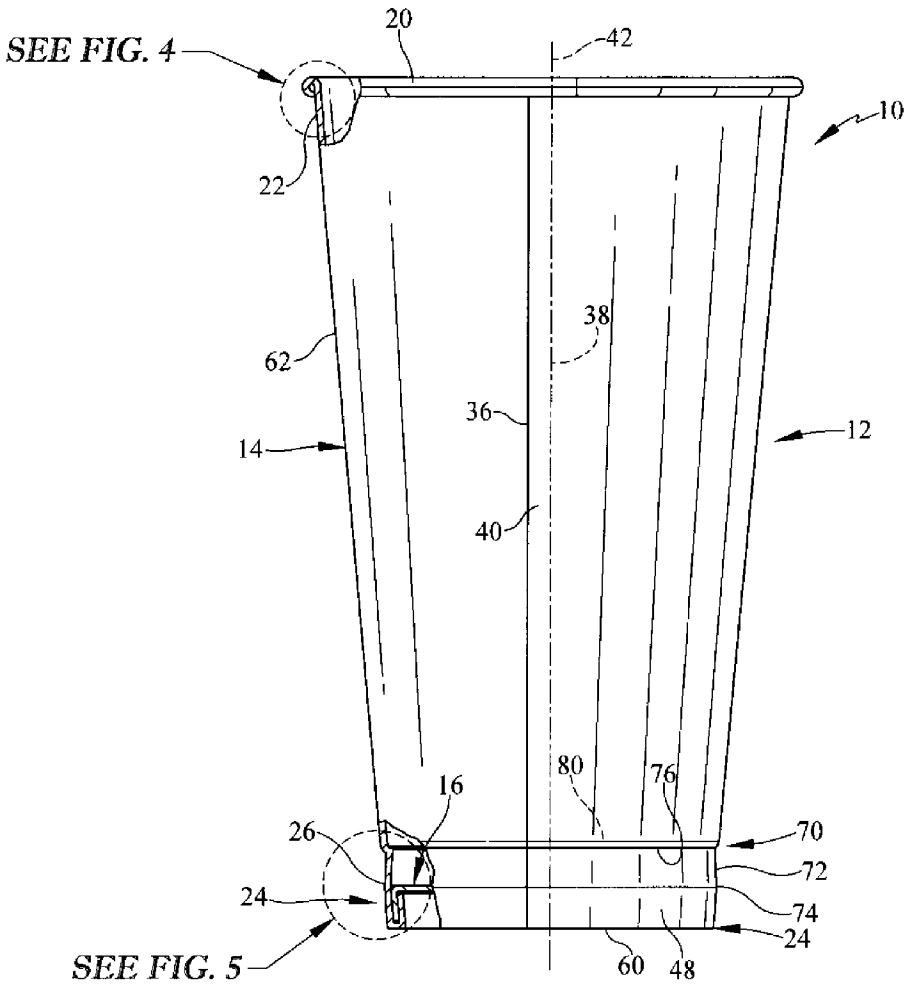
Figure 4:
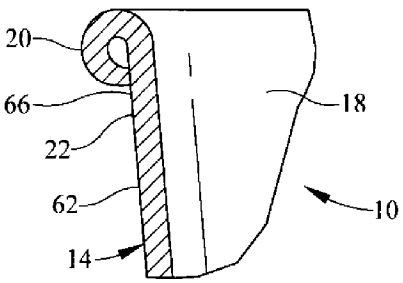
Figure 5:
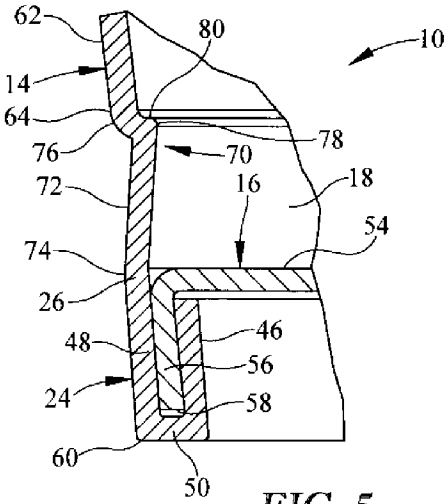
Figure 6:
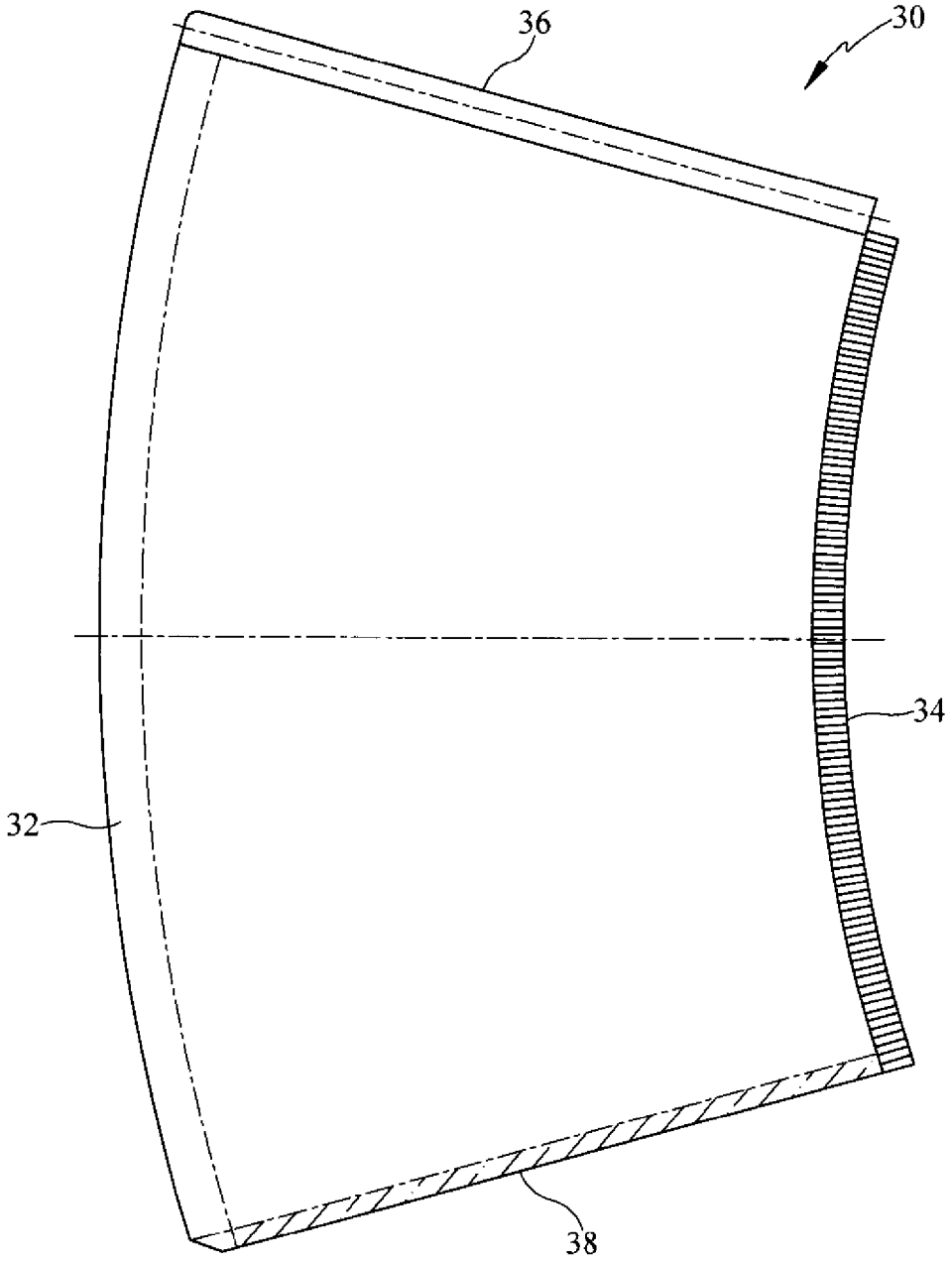

FIG. 3 is a side elevational view of the insulative cup showing a side-wall seam of the sleeve-shaped side wall of the insulative cup, a top portion of the insulative cup cut away to show an upper portion of the sleeve-shaped side wall and a rolled brim of the insulative cup in cross section, and a bottom portion of the insulative cup cut away to show a bottom portion of the sleeve-shaped side wall with the stack shoulder and a floor mount of the insulative cup in cross section;

FIG. 4 is an enlarged view of the cut-away top portion of the insulative cup of FIG. 3 showing the sleeve-shaped side wall and rolled brim of the insulative cup in cross section;

FIG. 5 is an enlarged view of the cut-away bottom portion of the insulative cup of FIG. 3 showing the bottom of the sleeve-shaped side wall with the stack shoulder and the floor mount of the insulative cup in cross section; and FIG. 6 is a plan view of a body blank for forming the body of the insulative cup.

DETAILED DESCRIPTION

Figure 1:
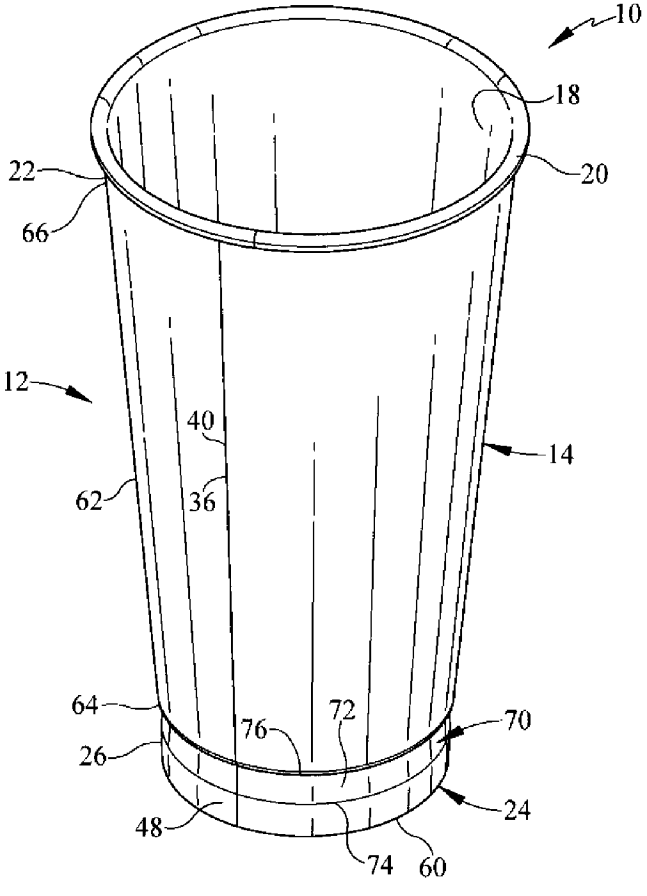
FIG. 1 is a perspective view of an insulative cup in accordance with the present disclosure showing that the insulative cup includes a body having a sleeve-shaped side wall with a stack shoulder formed in the sleeve-shaped side wall that extends around the entire circumference of the sleeve-shaped side wall.

An insulative cup in accordance with the present disclosure is shown in FIGS. 1 and 3. Insulative cup 10 includes a body 12 having a sleeve-shaped side wall 14 and a floor 16 coupled to body 12 to define an interior region 18 bounded by sleeve-shaped side wall 14 and floor 16. Body 12 includes a rolled brim 20 coupled to an upper end 22 of sleeve-shaped side wall 14 and a floor mount 24 coupled to a lower end 26 of sleeve-shaped side wall 14.

Body 12 is formed from a body blank 30 as shown in FIG. 6. Body blank 30 is initially generally planar and is embodied as a circular ring having a first arcuate edge 32 and a second arcuate edge 34. First arcuate edge 32 and second arcuate edge 34 are each curved in the form of an arc of a circle. Body blank 30 also includes a first linear edge 36 and a second linear edge 38 that extend between first arcuate edge 32 and second arcuate edge 34. First linear edge 36 and second linear edge 38 extend along respective radii from the same center of a circle.

Body blank 30 is roll formed into a generally conical configuration wherein a portion of body blank 30 that extends along first linear edge 36 of body blank 30 overlaps a portion of body blank 30 that extends along second linear edge 38 of body blank 30. First linear edge 36 of body blank 30 and second linear edge 38 of body blank 30 and the overlapping portions of body blank 30 are heat sealed to one another to form a body seam. First arcuate edge 32 forms rolled brim 20 and second arcuate edge 34 of body blank 30 forms floor mount 24. Sleeve-shaped side wall 14 includes a side wall seam 40, that comprises a portion of the body seam, and that extends along sleeve-shaped side wall 14 from rolled brim 20 to floor mount 24. Insulative cup 10 includes a linear central axis 42.

Body blank 30, and thereby sleeve-shaped side wall 14, rolled brim 20 and floor mount 24, may be formed from an insulative cellular non-aromatic polymeric material which may comprise, for example, a polypropylene base resin having a high melt strength, one or both of a polypropylene copolymer and homopolymer resin, and one or more cell-forming agents. As an example, cell-forming agents may include a primary nucleation agent, a secondary nucleation agent, and blowing agent defined by gas means for expanding the resins and to reduce density. One example, the gas means comprises carbon dioxide. Another example, the base resin comprises broadly distributed molecular weight polypropylene characterized by a distribution that is unimodal and not bimodal. Floor 16 may be made from the same material as body blank 30.

Floor mount 24 of body 12 is coupled to lower end 26 of sleeve-shaped side wall 14 and to floor 16 to support floor 16 in a stationary position relative to sleeve-shaped side wall 14. Floor mount 24 includes a floor-retaining flange 46 coupled to floor 16, a web-support ring 48 coupled to lower end 26 of sleeve-shaped side wall 14 and arranged to surround floor-retaining flange 46, and a connecting web 50 arranged to interconnect floor-retaining flange 46 and web-support ring 45 as suggested in FIG. 5. Floor-retaining flange 46, web-support ring 48 and connecting web 50 each have a generally annular shape.

Floor 16 of insulative cup 10 includes a horizontal platform 54 bounding a portion of interior region 18 and a platform-support member 56 coupled to horizontal platform 54 as shown, for example, in FIG. 5. Platform 54 is generally circular. Central axis 42 extends through the center of the platform 54 generally perpendicular to platform 54. Platform-support member 56 is ring-shaped and arranged to extend downwardly and away from horizontal platform 54 and interior region 18 into an annular space 58 provided between floor-retaining flange 46 and web-support ring 48 as suggested in FIG. 5. Platform-support member 56 of floor 16 has an annular shape and is arranged to surround floor-retaining flange 46. Floor-retaining flange 46 is coupled to floor 16 to retain floor 16 in a stationary position relative to sleeve-shaped side wall 14.

Web-supporting ring 48 of floor mount 24 is generally in the shape of a frustum of a cone. Web-supporting ring 48 extends generally concentrically about central axis 42 of insulative cup 10. Web-supporting ring 48 extends outwardly and away from central axis 42 as web-supporting ring 48 extends from a bottom edge 60 toward lower end 26 of sleeve-shaped side wall 14 at a desired angle of inclination with respect to central axis 42.

Sleeve-shaped side wall 14 includes an upper side-wall portion 62 that extends from a bottom end 64 to a top end 66 located at upper end 22 of sleeve-shaped side wall 14 and adjacent rolled brim 20. Upper side-wall portion 62 extends generally concentrically about central axis 42. Upper side-wall portion 62 is in the general shape of a frustum of a cone wherein upper side-wall portion 62 extends outwardly and away from central axis 42 as upper side-wall portion 62 extends from bottom end 64 toward top end 66 at a desired angle of inclination with respect to central axis 42. The angle of inclination of upper side-wall portion 62 with respect to central axis 42 may be the same as, or different from, the angle of inclination of web-support ring 48 with respect to central axis 42. Upper side-wall portion 62 of sleeve-shaped side wall 14 and web-support ring 48 of floor mount 24 may comprise respective portions of the same frustum of a cone.

Sleeve-shaped side wall 14 of insulative cup 10 includes a generally annular stack shoulder 70 located between floor mount 24 and upper side-wall portion 62 of sleeve-shaped side wall 14. Stack shoulder 70 is formed in sleeve-shaped side wall 14 by the application of pressure and heat to sleeve-shaped side wall 14.

Stack shoulder 70 includes a seat-support ring 72 that extends from a lower end 74 to an upper end 76. Lower end 74 of seat-support ring 72 may be located adjacent a top end of web-support ring 48 and at lower end 26 of sleeve-shaped side wall 14, or may be spaced apart therefrom. Upper end 76 of seat-support ring 72 is located adjacent bottom end 64 of upper-side wall portion 62 of sleeve-shaped side wall 14. Upper end 76 of seat-support ring 72 extends inwardly into interior region 18 of insulative cup 18 such that upper end 76 of seat-support ring 72 forms an annular peripheral ledge 78 having a generally circular and annular seat 80. Ledge 78 and seat 80 extend inwardly from the bottom end 64 of upper side-wall portion 62 into interior region 18. Seat 80 extends generally horizontally in a plane generally perpendicular to central axis 42 and generally parallel to horizontal platform 54 of floor 16.

Seat-support ring 72 is generally annular in shape and extends generally concentrically about central axis 42. Seat-support ring 72 extends from lower end 74 toward upper end 76 at an angle of inclination with respect to central axis 42 that is less than the angle of inclination at which upper side-wall portion 62 of sleeve-shaped side wall 14 extends with respect to central axis 42. Seat-support ring 72 may be generally cylindrical such that its angle of inclination with respect to central axis 42 is zero degrees.

Stack shoulder 70, including each of seat-support ring 72, ledge 78 and seat 80, extends uninterrupted and continuously in a generally circular manner about central axis 42 and around and along the entire perimeter of sleeve-shaped side wall 14, including through and across side-wall seam 40 of sleeve-shaped side wall 14. Seat 80 of ledge 78 is adapted to receive and engage the bottom edge 60 of another cup that is located in interior region 18 of insulative cup 10.

Figure 2:
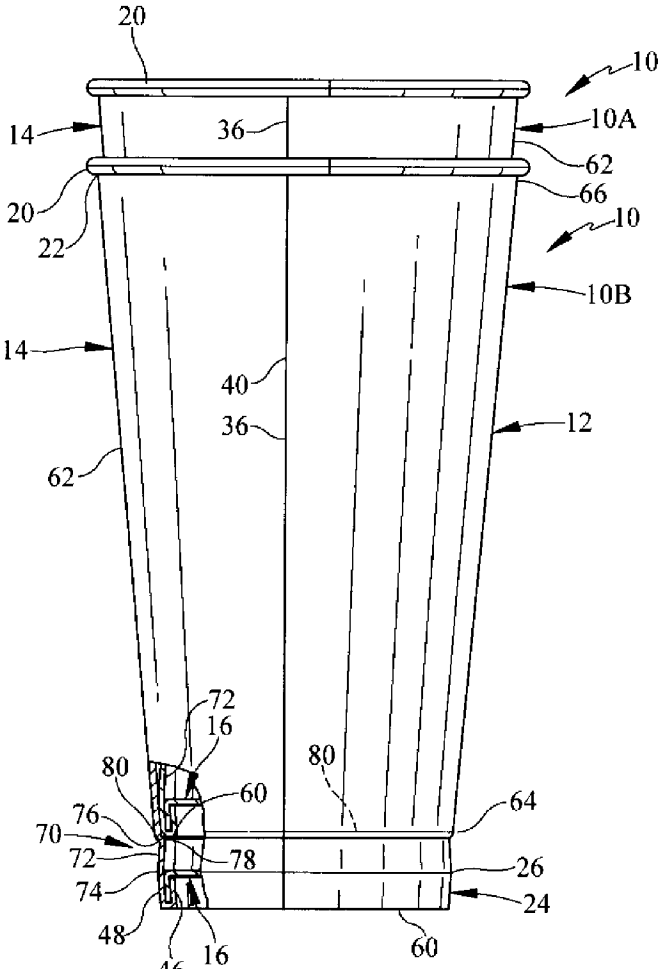
FIG. 2 is a side elevational view of an inner insulative cup stacked within an outer insulative cup, with a bottom portion of the insulative cups cut away to illustrate a bottom end of the interior insulative cup being supported on the stack shoulder of the outer insulative cup.

A first insulative cup 10 may be associated with a second insulative cup 10 such that the first insulative cup 10 is removably located within interior region 18 of second insulative cup 10, such that the first insulative cup 10 comprises an inner insulative cup 10A and the second insulative cup 10 comprises an outer insulative cup 10B as illustrated in FIG. 2. When interior cup 10A is inserted into interior region 18 of outer cup 10B, upper side-wall portion 62 of sleeve-shaped side wall 14 of inner cup 10A extends along generally parallel to and closely adjacent to upper side-wall portion 62 of sleeve-shaped side wall 14 of outer cup 10B. When inner cup 10A is located within outer cup 10B, web-support ring 48 of inner cup 10A may extend along and generally parallel to upper side-wall portion 62 of sleeve-shaped side wall 14 of outer cup 10B.

Web-support ring 48 of insulative cup 10 has an outer diameter at bottom edge 60 that may be generally equal to or slightly shorter than an interior diameter of upper side-wall portion 62 at bottom end 64 and that is generally equal to or longer than an interior diameter of seat 80 of stack shoulder 70. Inwardly extending ledge 78 and seat 80 of stack shoulder 70 of outer cup 10B is thereby adapted to receive and support bottom edge 60 of web-support ring 48 of floor mount 24 of inner cup 10A.

Engagement of floor mount 24 of inner cup 10A with seat 80 of stack shoulder 70 of outer cup 10B prevents further insertion of inner cup 10A into outer cup 10B along central axis 42 and thereby prevents sleeve-shaped side wall 14 of inner cup 10A from becoming firmly wedged within and against sleeve-shaped side wall 14 of outer cup 10B, which would otherwise make it difficult to separate inner cup 10A from outer cup 10B. Stack shoulder 70 of outer cup 10B limits how far inner cup 10A can be inserted into interior region 18 of outer cup 10B. Stack shoulder 70 thereby enables inner cup 10A to be removably located within outer cup 10B for stacking while providing for easy separation of stacked cups 10A and 10B from one another.

The invention claimed is:

1. An insulative cup comprising a side wall formed from an insulative cellular non-aromatic polymeric material having an upper end formed to include a brim defining a mouth opening having a central axis extending into an interior region formed at least in part by the side wall, a floor retaining flange configured at a lower end of the side wall, the floor retaining flange adapted to secure a floor mount supporting a platform to close off a lower portion of the interior region, and a stack shoulder formed in the side wall, the stack shoulder comprising an annular seat located in a lower portion of the side wall above the platform, the annular seat providing a support surface for another cup, wherein the side wall inclines inward with respect to the central axis between the platform and the stack shoulder wherein a first portion of the side wall along a first linear edge overlaps a second portion of the side wall along a second edge and are heat sealed together to form a body seam, wherein a floor includes the platform and a platform support member, the platform support member is coupled to the floor retaining flange by use of a heat seal, and further including a web support ring portion coupled to the lower portion of the side wall and arranged to surround the platform support member, wherein the seat-support ring portion forms an obtuse included angle with the web support ring portion facing the central axis when viewed in cross section.

2. The insulative cup of claim 1, wherein a portion of the side wall below the annular seat is of a reduced diameter.

3. The insulative cup of claim 1, wherein the stack shoulder is formed in the side wall by the application of pressure and heat to the side wall.

4. The insulative cup of claim 1, wherein the annular seat extends generally horizontally in a plane generally perpendicular to the central axis of the insulative cup and generally parallel to the horizontal platform of the floor.

5. The insulative cup of claim 1, wherein the stack shoulder extends uninterrupted and continuously in a generally circular manner about the central axis of the insulative cup.

6. A method for assembling an insulative cup, the method comprising forming a body blank of an insulative cellular non-aromatic polymeric material, forming a side wall using the body blank without shrinking, the side wall having an upper end comprising a brim defining a mouth opening having a central axis extending into an interior region bounded at least in part by the side wall, securing a floor mount supporting a platform via a floor retaining flange, at a lower end of the side wall, to close off a lower portion of the interior region, and forming a stack shoulder in the side wall of the cup, the stack shoulder comprising an annular seat located in a lower portion of the side wall, the annular seat providing a support surface, wherein the side wall inclines inward with respect to the central axis between the platform and the stack shoulder, wherein forming the side wall comprises overlapping a first portion of the side wall along a first linear edge to a second portion of the side wall along a second edge and heat sealing the overlapping portions to form a body seam, wherein a floor comprises the platform and a platform support member, and wherein securing the floor mount comprises coupling the platform support member and the floor mount to the floor retaining flange by use of a heat seal, and further comprising coupling a web support ring portion to the lower portion of the side wall to surround the platform support member, wherein the stack shoulder includes a seat-support ring portion that extends to the web support ring portion, and wherein the seat-support ring portion forms an obtuse included angle with the web support ring portion facing the central axis when viewed in cross section.

7. The method of claim 6, wherein a portion of the side wall below the annular seat is of a reduced diameter.

8. The method of claim 6, further comprising forming the stack shoulder in the side wall by the application of pressure and heat to the side wall.

9. The method of claim 6, wherein the annular seat extends generally horizontally in a plane generally perpendicular to the central axis of the cup and generally parallel to the horizontal platform of the floor mount.

10. The method of claim 6, wherein the stack shoulder extends uninterrupted and continuously in a generally circular manner about the central axis of the cup.

11. An insulative cup comprising a body comprising insulative cellular non-aromatic polymeric material and a side wall having an upper end defining a mouth opening into an interior region formed in the body, a floor mount coupled to a lower end of the side wall, and a floor coupled to the floor mount and a stack shoulder including an annular seat coupled to the lower end of the side wall to extend into the interior region and located between the upper end of the side wall and floor mount and seat-support ring arranged to extend between and interconnect the annular seat and the floor mount, wherein the floor includes a horizontal platform and a platform-support member coupled to the horizontal platform to extend away from the interior region and couple to the floor mount, wherein the floor mount includes a floor-retaining flange coupled to the platform-support member, a connecting web coupled to the floor-retaining flange to extend radially outward away from the floor-retaining flange and lie in spaced-apart relation to the platform-support member, and a web-support ring arranged to extend between and interconnect the connecting web and the seat-support ring and locate the floor-retaining flange therebetween, wherein the horizontal platform is located a first distance from the connecting web and the web-support ring couples to the seat-support ring about the first distance from the connecting web, and wherein the seat-support ring portion forms an obtuse included angle with the web support ring portion facing a central axis when viewed in cross section.

* * * * *